US005372257A

United States Patent [19]

Beauchamp et al.

[11] Patent Number: 5,372,257

[45] Date of Patent: Dec. 13, 1994

[54] STACKABLE LOAD BEARING TRAY

[75] Inventors: Maurice Beauchamp, St-Damien; Michel Lanoue, Ste-Foy, both of Canada

[73] Assignee: IPL Inc., Quebec, Canada

[21] Appl. No.: 230,375

[22] Filed: Apr. 20, 1994

[51] Int. Cl.[5] ..... B65D 21/04

[52] U.S. Cl. ..... 206/504; 206/505; 206/509

[58] Field of Search ..... 206/504, 505, 509, 23.4, 206/511

[56] References Cited

U.S. PATENT DOCUMENTS

| | | | |
|---|---|---|---|
| 4,760,921 | 8/1988 | Licari | 206/509 |
| 4,911,303 | 3/1990 | Andersson | 206/509 |
| 4,998,967 | 3/1991 | Box | 206/509 |
| 5,190,156 | 3/1993 | Conaway et al. | 206/509 |
| 5,287,966 | 2/1994 | Stahl | 206/509 |

*Primary Examiner*—Joseph Man-Fu Moy
*Attorney, Agent, or Firm*—Cushman, Darby & Cushman

[57] ABSTRACT

The disclosure herein describes a stackable tray which is formed of a body of rigid plastic material with a bottom wall integrally formed with opposite side walls and front and rear walls; each side wall is provided with an upper edge flange which is engageable in a recessed area defined in the lower edge of a superposed similarly constructed tray. The location of the recessed area with respect to the upper edge flange is such as to force outwardly the side walls during stacking engagement thus causing internal stresses in the bottom wall which counteract the sagging which occurs when loads are supported on the bottom wall.

8 Claims, 7 Drawing Sheets

STACKABLE LOAD BEARING TRAY

FIELD OF THE INVENTION

The present invention relates to a tray which is adapted to be stacked with similarly constructed load bearing trays.

BACKGROUND OF THE INVENTION

At present, bread loaves are transported and delivered in stores in stackable trays which are formed of a body of rigid plastic material and which consist of a bottom wall integrally formed with opposite side walls, a rear wall and a front low display wall. The structural configuration of the trays is such that, for a stacked arrangement, they are simply placed one on top of the other, the lower edge of a tray resting on the upper edge of the lower tray.

However, it has been found that, when the trays are loaded with articles and a number of them are stacked, there is a downward sagging force exerted on the bottom wall on the front side thus causing an inward movement of the side walls, which movement is further increased as the number of loaded superposed trays becomes important. One solution being used is to increase the height of the front ribs while another solution is to add a metallic reinforcement in the front wall of the tray.

OBJECT AND STATEMENT OF THE INVENTION

An object of the present invention is to overcome the above described problems with existing trays, especially bread trays. This is achieved by providing a tray which further enhances engagement when trays are in a stacking arrangement. The construction of the tray is such that, during stacking, an outward force is exerted on the side walls resulting in an upward bending moment in the bottom wall to thereby counteract the forces exerted by the weight of the loads resting on the bottom wall.

The present invention therefore relates to a stackable tray which comprises a body formed of a rigid plastic material and consisting of a bottom wall integrally formed with opposite side walls and opposite front and rear walls; the front wall defines an access area to allow removal of articles, such as bread loaves, from the bottom wall when the tray is in superposed stacked relationship with similarly constructed trays. Each side wall defines an upper edge with a flange and a lower edge with a recessed area in which is received the upper edge flange of a similarly constructed tray disposed therebeneath. The recessed area, prior to stacking engagement, extends in a vertical plane slightly offset outwardly relative to a vertical plane including the upper edge flange whereby, during stacking, the upper edge flange forcingly engages in the recessed area causing an outward movement of the side wall which counteracts sagging of the bottom wall due to the weight of articles thereon.

In one form of the invention, the lower edge includes a series of sloping ribs to assist in the stacking engagement and in the outward movement of the sidewall of a lower tray.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

Figure 1:
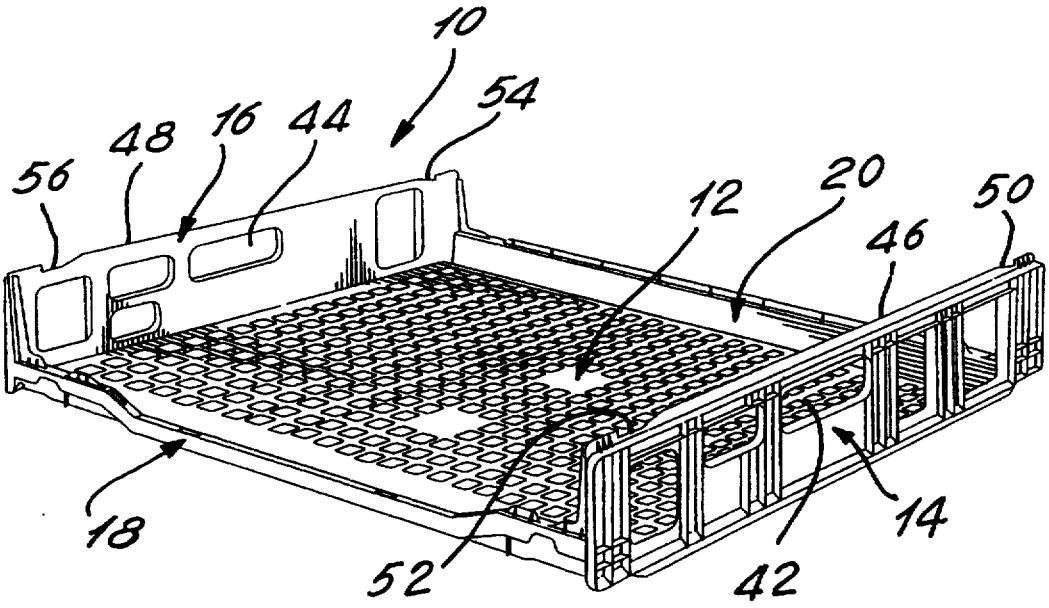
FIG. 1 is a front perspective view a tray made in accordance with the present invention.

Referring to FIG. 1, there is shown a stackable tray, generally denoted 10, constructed in accordance with the present invention and having a body formed of a rigid plastic material, such as a high density polyethylene, and consisting of a bottom wall 12 integral with opposite side walls 14 and 16, front wall 18 and rear wall 20.

Figure 2:
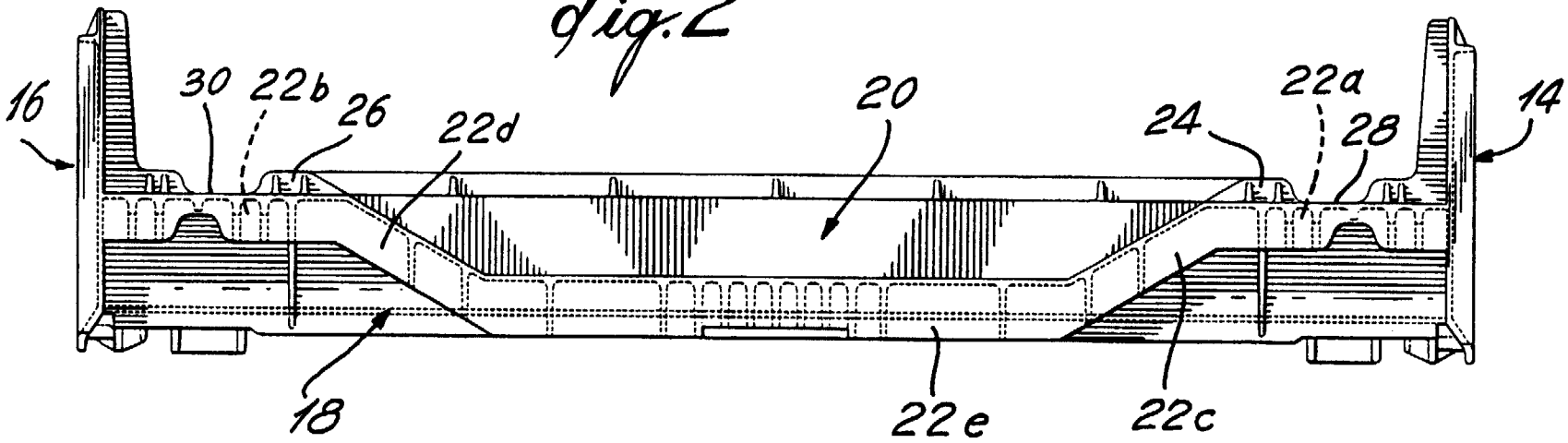
FIG. 2 is a front elevation thereof.

Referring to FIG. 2, the front wall 18 displays an inverted U-shaped upper edge 22 including a pair of horizontal side sections **22*a* and 22*b*, adjacent to side walls 14 and 16 respectively, and a pair of inclined sections 22*c* and 22*d* sloping down to a lower central section 22*e*. Sections 22*c*, 22*d* and 22*e* define an access area on the front wall allowing one to place or retrieve articles on and from the bottom wall 12. Sections 22*a* and 22*b* display upwardly extending flanges 24 and 26, respectively, each including a recess at 28 and 30**.

Figure 3:
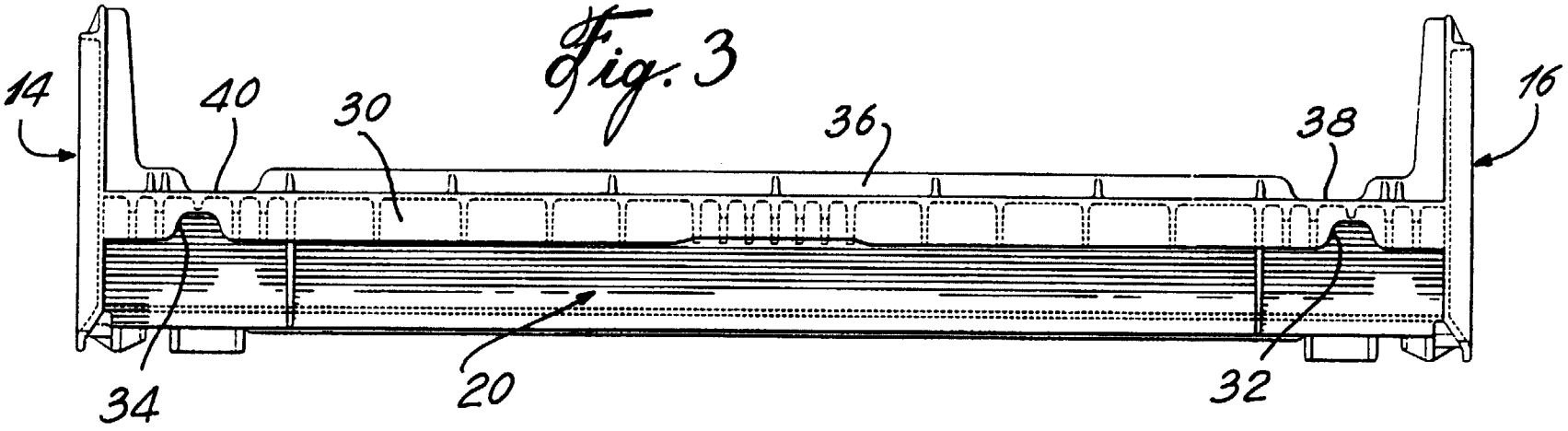
FIG. 3 is a rear elevation thereof.

Referring to FIG. 3, the rear wall 20 displays an upper inverted U-shaped edge 30 extending horizontally between the opposite side walls 14 and 16. The lower part of the edge comprises two recesses 32 and 34 while the upper part displays a vertically extending flange 36 which also displays a pair of recesses 38 and 40.

Figure 4:
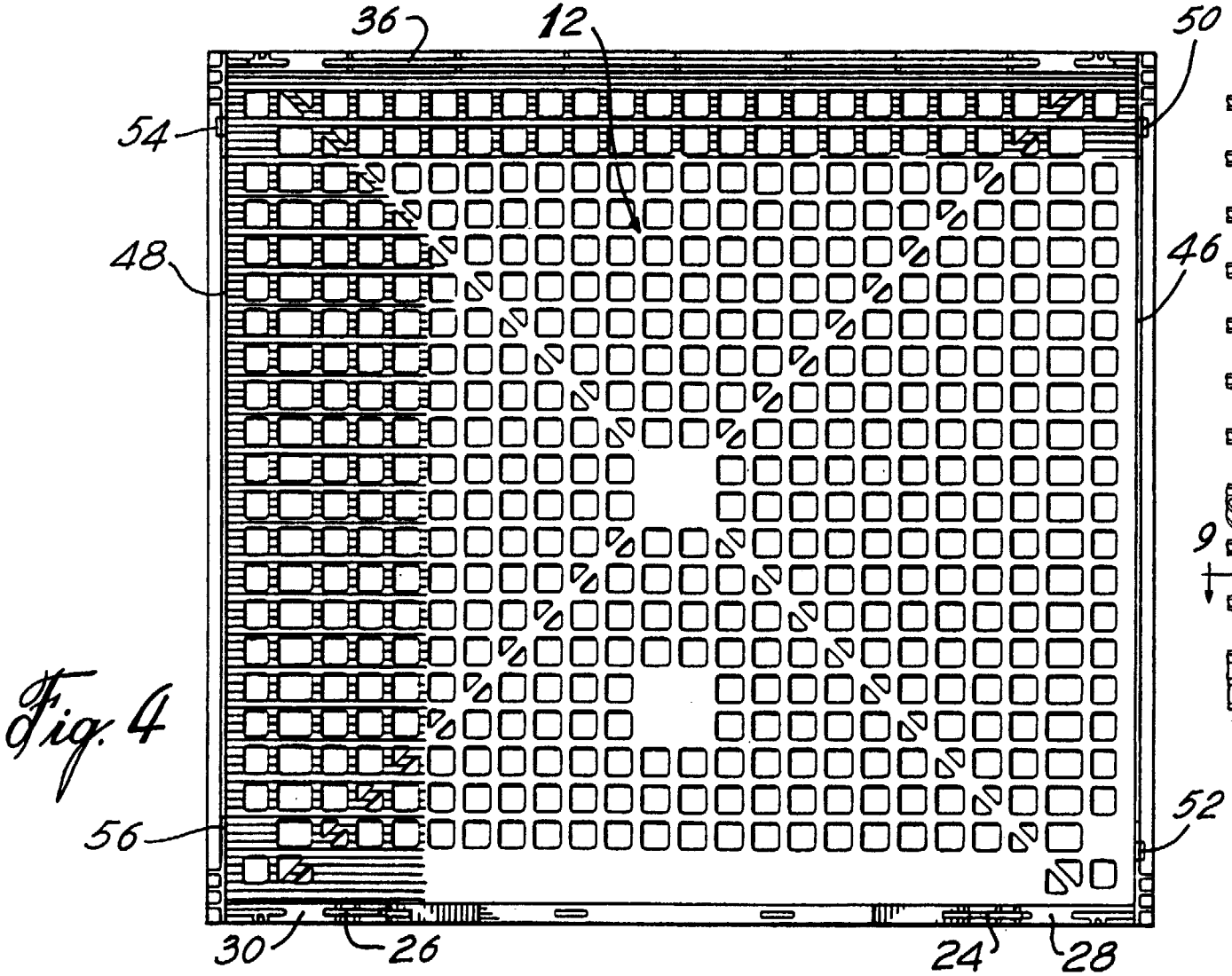
FIG. 4 is a top plan view thereof.
Figure 6:
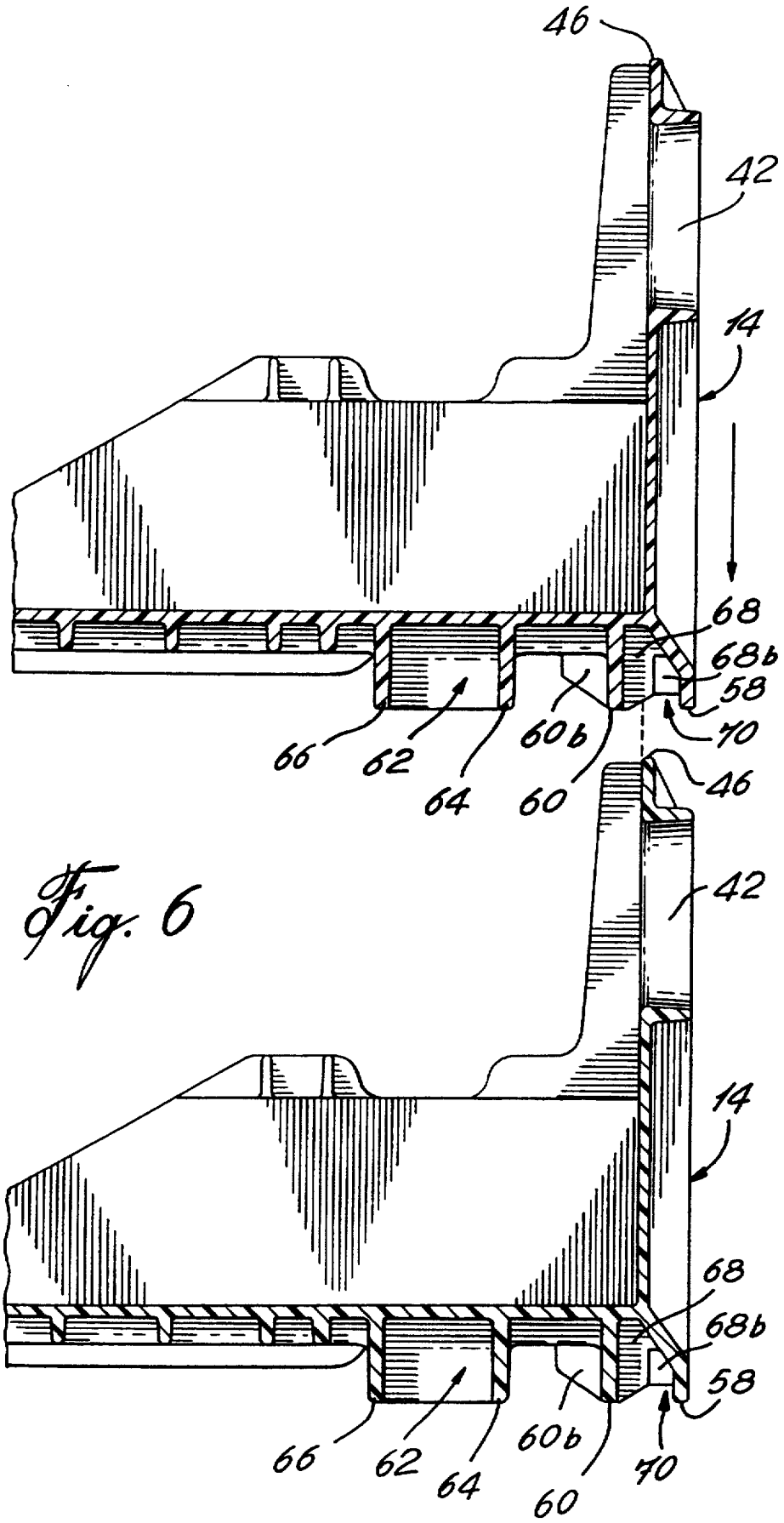
FIG. 6 is an enlarged cross-sectional fragmental view showing two superposed trays prior to stacking.

Referring to FIG. 4, the bottom wall 12 displays a flat upper face that includes a series of rectangular and triangular openings providing lightness to the tray.

Referring also to FIG. 1, each side wall 14, 16 displays a series of openings, also to provide lightness to the tray; two of these openings, 42 and 44, serve as handles for carrying the tray. The side walls 14 and 16 also include an upper projecting flange 46 and 48, each displaying two recesses 50, 52, and 54, 56.

Figure 5:
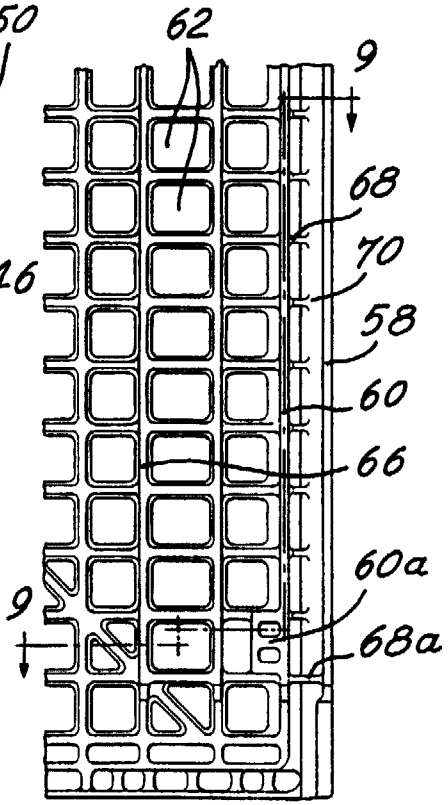
FIG. 5 is an enlarged fragmental bottom view of one corner of the tray.

FIG. 5 shows a bottom view of one corner of the tray; however, all four corners of the tray are of an identical construction. The lower edge of each side wall comprises an outer longitudinal flange 58 parallel to an inner longitudinal flange 60. A longitudinal arrangement of rectangular openings 62 formed by side walls 64 and 66 is disposed inwardly of flange 60. The lower edge of flanges 58, 60, 64 and 66 is lower than that of the remaining face of the bottom wall. Integral with flange 60 is a series of longitudinally spaced ribs 68 thus leaving a gap or recessed area 70 between the vertical edge of the ribs and the outer flange 58. The ribs 68*a* and 68*b* at opposite ends, adjacent of the front and rear walls, extend the full width of the area separating flanges 58 and 60. Also, at each opposite end of flange 60, adjacent the front and rear walls, are blocks 60*a* and 60*b* which have a sloping lower face, the function of which will be described further hereinbelow. Similarly, ribs 68 have a sloping lower edge, the function of which will be described further hereinbelow.

Figure 7:
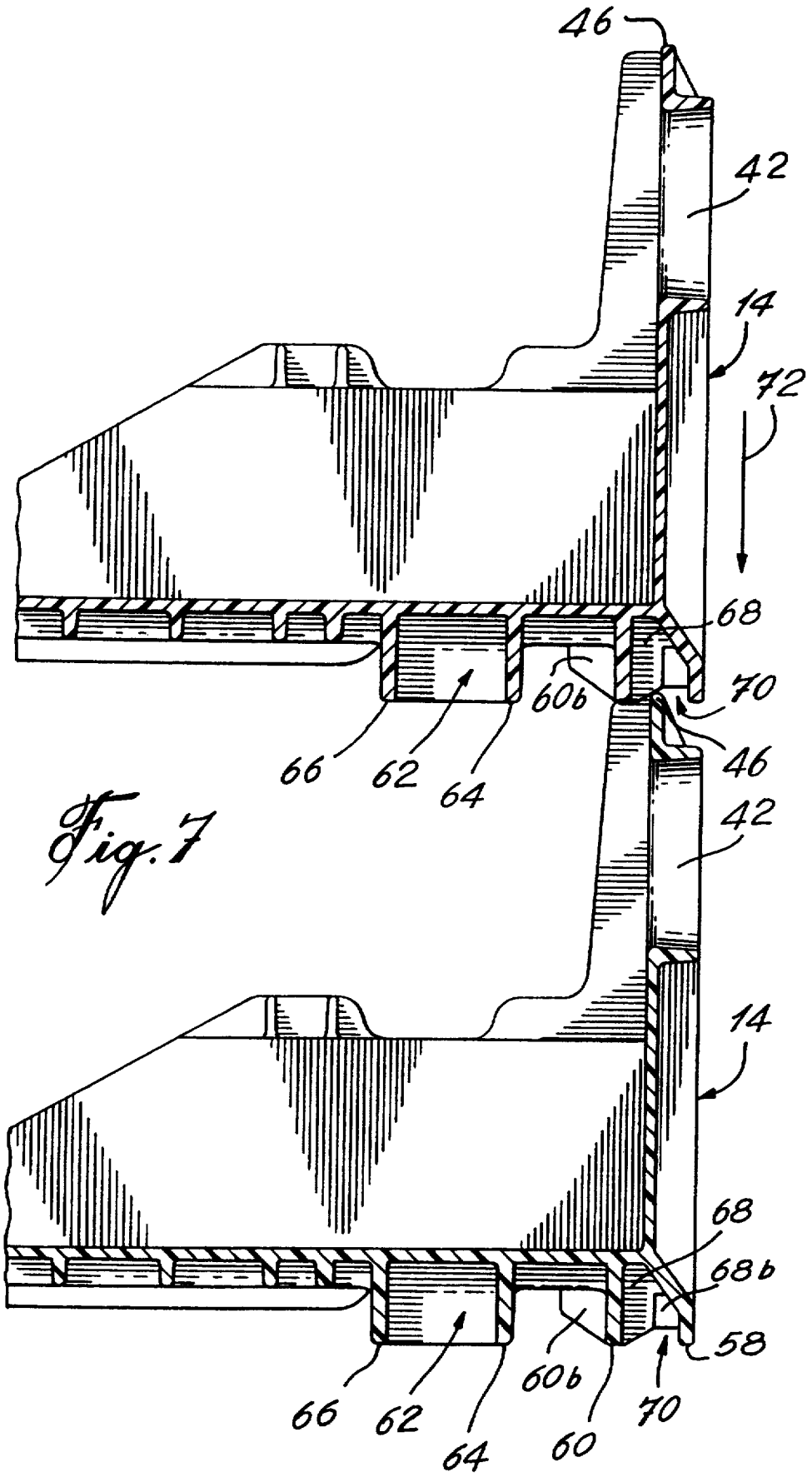
FIG. 7 is an enlarged cross-sectional view similar to that of FIG. 6 showing the trays in contact prior to engagement with one another.
Figures 8, 9:
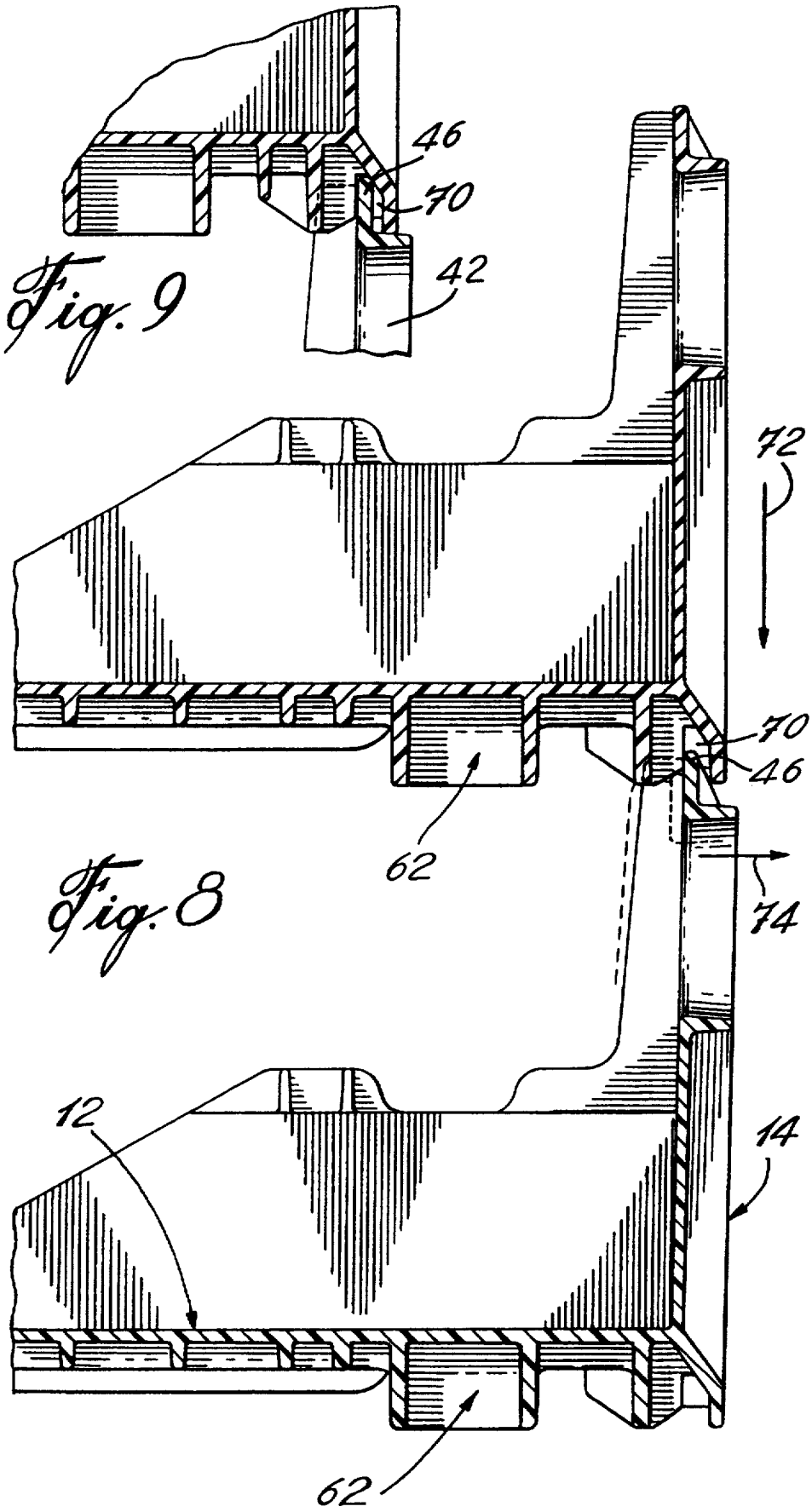
FIG. 8 is an enlarged cross-sectional view similar to that of FIG. 6 showing the trays during engagement.
FIG. 9 is an enlarged cross-sectional view taken along lines 9—9 of FIG. 5 and showing parts of two trays in full engagement.

Referring to FIGS. 6, 7, 8 and 9, the nesting steps of two superposed trays are illustrated. As can be seen in FIG. 7, first contact between the two trays occurs when the upper edge 46 of the lower tray contacts the sloping edge of ribs 68 in the direction indicate by arrow 70. In FIG. 8, as the upper tray is further lowered, as indicated by arrow 72, the side wall 14 of the lower tray is caused to move outwardly, as indicated by arrow 74, as a result of the upper flange 46 being forced into the recessed area 70. This outward movement of side walls 14 and 16 causes upward bending forces in the bottom wall 12 of the tray. Finally, in the position shown in FIG. 9, the two trays are shown fixed by secured with the upper flange 46 being entirely received within the area 70. The resiliency of the plastic material of the tray tends to return the side walls to their vertical position thus increasing frictional contact between the parts and securing the nesting engagement of the trays.

Figure 10:
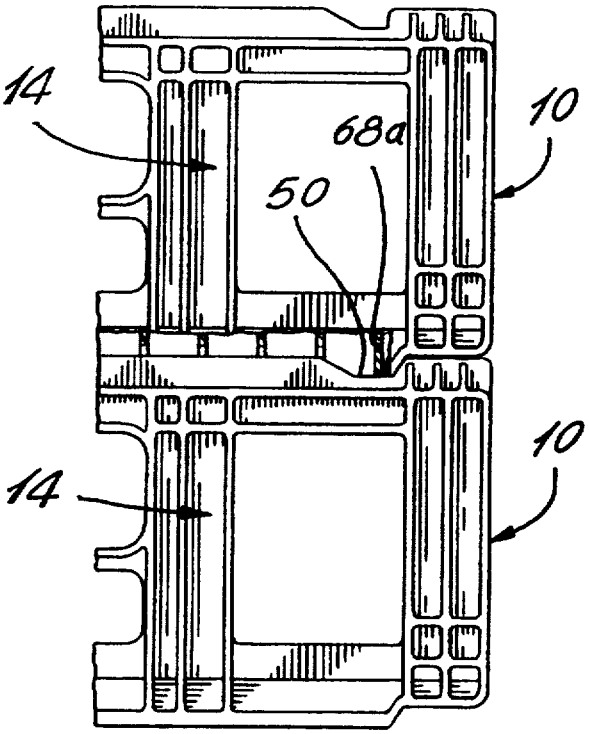
FIG. 10 is a fragmental side elevation showing two trays in a stacked condition.

Referring to FIG. 10, the stacked trays are prevented to move relative to one another in a direction parallel to the side walls as a result of the ribs 68*a* and 68*b* engaging their corresponding recesses 50 and 52 in the upper flange 46. Similar engagement is achieved in the opposite side wall 16 of the tray.

Figure 11:
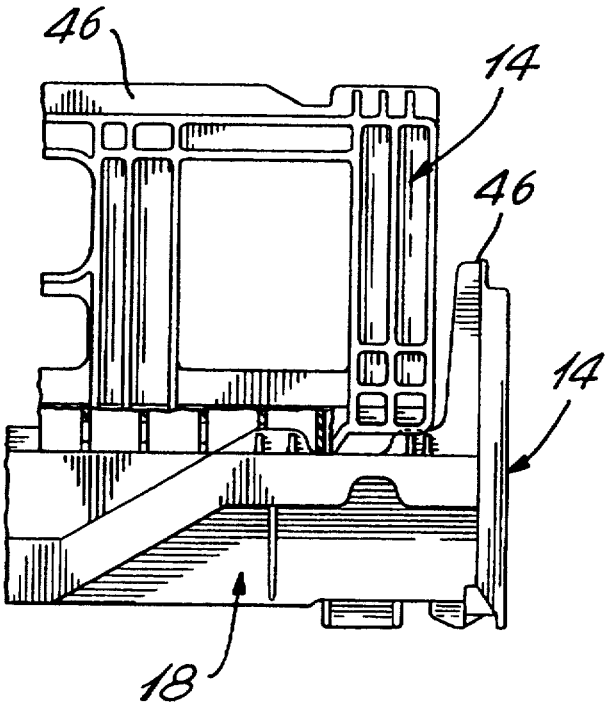
FIG. 11 is a fragmental front elevation showing two trays in a nested arrangement.

The tray is preferably rectangular with the front end rear walls being wider than the side walls so that, when the trays are not used for displaying articles, such as bread loaves, they may be nested in one another such as illustrated in FIG. 11 with the front and rear walls of a tray being received adjacent and parallel to the side walls of a lower tray. The nesting is facilitated by the upper flanges 24, 26 of the front wall and 36 of the rear wall sliding along the sloping lower faces of blocks 60*a* and 60*b* to thereafter slide into the area between the blocks and the vertical flange 64.

Although the invention has been described above in relation to a specific form, it will be evident to the man skilled in the art that it may be modified and refined in various ways. For example, an access area may also be provided on the rear wall thus allowing removal or placing of articles from or on both sides of the tray when in stacked arrangement with other trays. It is therefore wished to have it understood that the invention should not be limited in interpretation, except by the terms of the following claims.

The embodiments of the invention in which an exclusive property or privilege is claimed are defined as follows:

1. A stackable tray comprising a body formed of a rigid plastic material and consisting of a bottom wall integrally formed with opposite side walls and opposite front and rear walls, said front wall defining an access area to allow removal of articles from said bottom wall when said tray is in superposed stacked relationship with similarly constructed trays; each said side wall having an upper edge defining an upstanding flange and a lower edge including a recessed area to receive therein the upper edge flange of a similarly constructed tray disposed therebeneath; said recessed area, prior to stacking engagement, extending in a vertical plane slightly offset outwardly relative to a vertical plane including said upper edge flange whereby, during stacking, said upper edge flange forcingly engages in said recessed area causing an outward movement of said side wall to thereby counteract sagging of said bottom wall due to the weight of articles placed thereon.

2. A stackable tray as defined in claim 1, wherein said recessed area of said lower edge includes a series of ribs displaying a lower sloping edge which is contacted by said upper edge flange of a lower disposed tray prior to be forcingly engaged in said recessed area.

3. A stackable tray as defined in claim 2, wherein said recessed area displays, at opposite ends thereof adjacent said front and rear walls, a transverse rib; said upper edge flange displaying, at opposite ends thereof adjacent said front and rear walls, a recess into which the transverse ribs of a superposed similarly constructed tray are received during stacking.

4. A stackable tray as defined in claim is wherein the height of each said side wall is greater than the height of said front and rear walls and wherein the distance between said side walls is greater than the distance between said front and rear walls whereby the trays are nestable with each successive tray being disposed at 90° relative to one another.

5. A stackable tray as defined in claim 4, wherein said front and rear walls display an upwardly extending flange, each flange including, at opposite ends thereof adjacent said side walls, a recess; and wherein said bottom wall includes, adjacent said recessed area at said lower edge of said side walls, a further recessed area receiving therein said flanges of said front and rear walls during nesting.

6. A stackable tray as defined in claim 5, wherein each said further recessed area includes, at opposite ends thereof adjacent said front and rear walls, a block having a sloping face to assist in the nesting of trays.

7. A stackable tray as defined in claim 1, wherein each said side wall includes a series of openings; one of said openings being centrally located and serving as a handle for carrying said tray.

8. A stackable tray as defined in claim 1, wherein said rigid plastic material is a high density polyethylene.

* * * * *